US005255846A

United States Patent [19]

Ortega

[11] Patent Number: 5,255,846

[45] Date of Patent: Oct. 26, 1993

[54] SPRAY CONTROL APPARATUS FOR USE WITH TEXTURIZER MACHINES

[76] Inventor: Raymond A. Ortega, 941 4th Ave., Sacramento, Calif. 95818

[21] Appl. No.: 947,539

[22] Filed: Sep. 21, 1992

[51] Int. Cl.[5] ..... B05B 7/30; B05B 15/06; B05B 1/26

[52] U.S. Cl. ..... 239/103; 239/273; 239/345; 239/394; 239/499

[58] Field of Search ..... 239/103, 104, 120–122, 239/273, 275, 280, 288–288.5, 345, 346, 394, 499; 248/75, 76, 79, 83

[56] References Cited

U.S. PATENT DOCUMENTS

| | | | |
|---|---|---|---|
| 1,792,803 | 2/1931 | Brandt | 239/280 |
| 1,828,463 | 10/1931 | Hammers | 239/103 |
| 2,978,186 | 4/1961 | Mayerchak | 239/103 |
| 3,430,862 | 3/1969 | Broderick et al. | 239/280 |
| 3,583,634 | 6/1971 | Sheetz | 239/103 |
| 4,364,521 | 12/1982 | Stankowitz | 239/346 |
| 4,411,387 | 10/1983 | Stern et al. | 239/345 |
| 4,494,699 | 1/1985 | Hengesbach | 239/499 |
| 4,863,104 | 9/1989 | Masterson | 239/390 |
| 4,865,257 | 9/1989 | Bailey | 239/499 |
| 5,069,390 | 12/1991 | Stern et al. | 239/345 |

FOREIGN PATENT DOCUMENTS

| | | | |
|---|---|---|---|
| 527941 | 11/1957 | Italy | 239/499 |

*Primary Examiner*—Andres Kashnikow
*Assistant Examiner*—Karen B. Merritt
*Attorney, Agent, or Firm*—Thomas R. Lampe

[57] ABSTRACT

A deflector is attached to a texturizer sprayer, the deflector being in the shape of a truncated cone with a tapered deflector wall which intercepts a portion of the stream of air-entrained texturizing material emitted by the sprayer. The deflector forms a more concentrated stream and focused spray pattern. The deflector includes a collection chamber for collecting and retaining texturizing material failing to exit the open end of the deflector. Support legs are provided to support the combined texturizer sprayer and deflector.

10 Claims, 5 Drawing Sheets

SPRAY CONTROL APPARATUS FOR USE WITH TEXTURIZER MACHINES

TECHNICAL FIELD

This invention relates to spray apparatus, and more particularly, to spray machines utilized to spray acoustics, drywall mud, stucco, and other types of texturizer materials. The present invention is more specifically directed to a means to control and provide a more concentrated stream of air-entrained texturizing material and a more focused spray pattern, as compared to conventional prior art arrangements.

BACKGROUND ART

Texturizer spray machines are in common usage for applying drywall mud and other materials. Quite commonly, the spray machines employ a hand-held spray gun to which is attached a hopper for the material to be sprayed. The person utilizing the spray machine manually supports the machine and activates the spray gun to entrain texturizing material being fed from the hopper into a compressed air stream emitted from the air nozzle of the sprayer. Examples of spray machines of this type are the Pace Setter Gun and Hopper and the Pattern Pistol Gun and Hopper made available by Goldblatt of Osage, Kansas.

While prior art spray devices are highly satisfactory in many respects, problems are encountered in that the air-entrained texturizing material stream often can cover a greater area than desired. For example, the operator may have difficulty restricting spray application to a relatively confined area. Also, spatter may occur outside the area desired.

While attempts have been made to control application through use of interchangeable air nozzles and different sized orifices in the gun, such approaches are both inconvenient and relatively ineffective.

Another problem arises due to the fact that conventional texturizer spray guns have a propensity to drip texturizer material.

Yet another problem encountered when utilizing conventional hand-held spray machines is that the operator has difficulty storing or supporting the unit when it is not actually in use. That is, conventional spray machines of the hand held type have a propensity to tip and spill the contents of the hopper when not being supported by the operator. While it is conventional practice for an operator to attempt to prop the unit against a wall or other support when not using it, the weight of the texturizing material in the hopper as well as the structural configuration and weight of the spray machine itself make it highly likely that the apparatus will tip and fall over, especially if subjected to even minor impact or vibration, as is often the case in construction environments.

DISCLOSURE OF INVENTION

The apparatus of the present invention addresses and solves the problems set forth above with respect to conventional spray machine arrangements, and does so quite inexpensively. Not only can the apparatus of the present invention be utilized to control the flow of air-entrained texturizing material to focus and concentrate same, the apparatus serves to support a texturizer sprayer machine in a highly stable fashion when it is not in use. Inadvertent drip of texturizing material is also reduced.

The combination of the present invention incorporates texturizer sprayer means including a nozzle gun and a hopper connected to the nozzle gun for furnishing texturizing material to the nozzle gun. The nozzle gun has at least one air nozzle and an orifice plate defining an orifice in communication with the at least one air nozzle. The orifice plate has an outer surface disposed adjacent to the at least one nozzle and radiating outwardly therefrom in a plane substantially perpendicular to the flow path of air emitted from the at least one air nozzle. The nozzle gun is operable to spray a diverging steam of air-entrained texturizing material away from the orifice plate, the diverging stream having an angle of divergence of a predetermined magnitude.

The apparatus includes deflector means including a tapered deflector wall defining a passageway and having an inner end and an outer end at opposed ends of the passageway. The inner end comprises a mounting wall defining an aperture and the outer end is open over substantially the full extent thereof.

Connector means is provided for connecting the deflector means to the nozzle gun, the mounting wall being in engagement with the orifice plate when the deflector means is connected to the nozzle gun with the mounting wall aperture in at least partial registry with the orifice.

The tapered deflector wall defines a second angle of divergence of a lesser magnitude than the angle of divergence defined b the diverging stream of air-entrained texturizing material whereby the air-entrained texturizing material will engage the tapered deflector wall and be redirected to form a more concentrated stream and focused spray pattern.

In the disclosed modes of the invention the deflector means is in the shape of a truncated cone with the tapered deflector wall diverging away from the mounting wall in the direction of the air-flow path.

According to the disclosed embodiments of the invention, the deflector means includes a collection chamber in communication with the passageway for collecting and retaining therein texturizing material failing to exit the open outer end of the deflector means.

According to the teachings of the present invention, the combination preferably includes support means projecting downwardly from the deflector wall to support the texturizer sprayer means and deflector means on a support surface.

Other features, advantages, and objects of the present invention will become apparent with reference to the following description and accompanying drawings.

MODES FOR CARRYING OUT THE INVENTION

Figure 1:
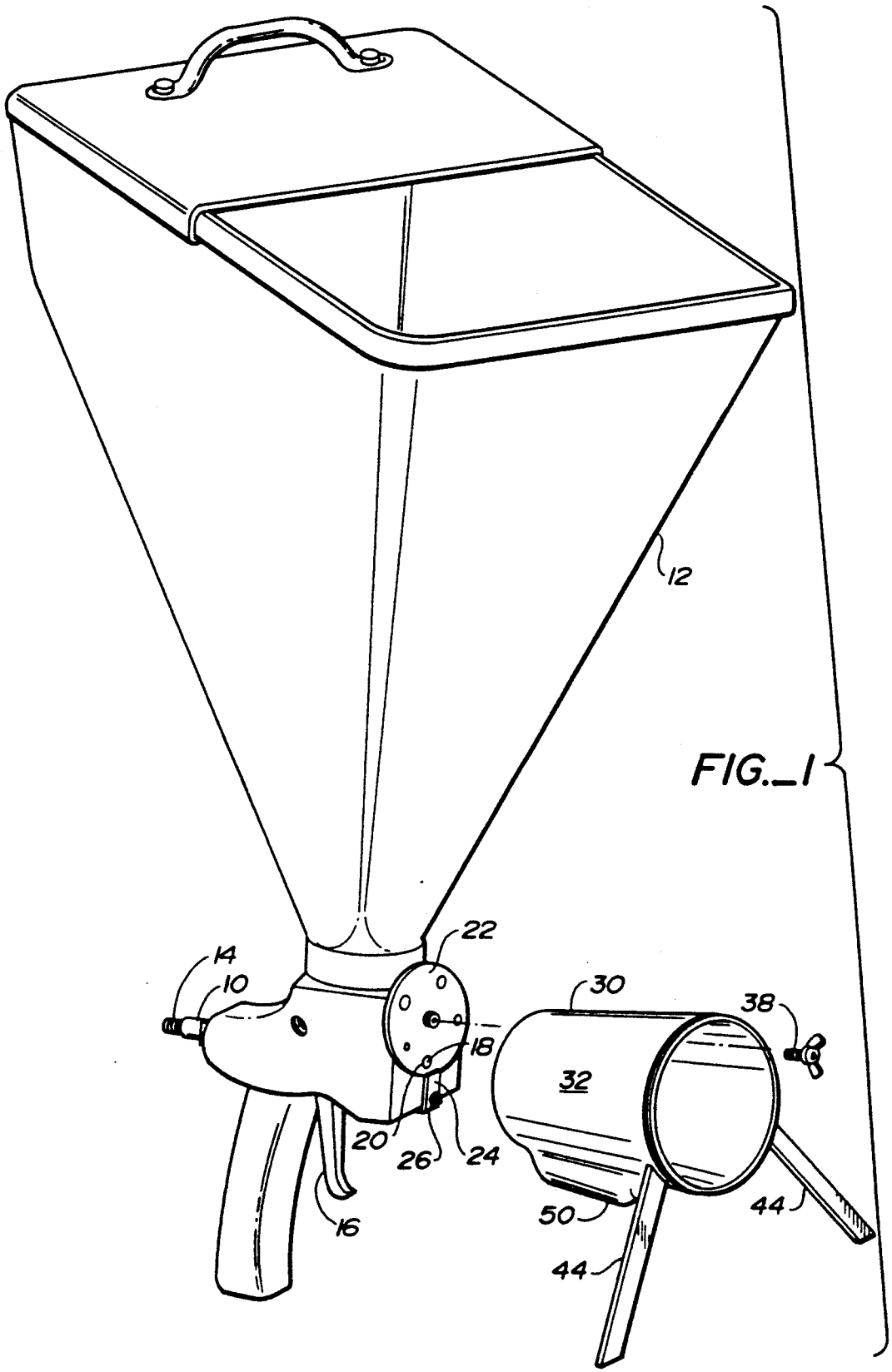
FIG. 1 is a perspective view of a form of apparatus constructed in accordance with the teachings of the present invention and including a texturizer sprayer means and deflector means.

Referring now to FIGS. 1-4, and in particular to FIG. 1, texturizer sprayer means including a nozzle gun 10 and a hopper 12 connected to the nozzle gun is illustrated. The nozzle gun 10 and hopper 12 may be of any suitable conventional construction. For example, the sprayer comprised of these two components may be the aforementioned Pace-Setter Gun and Hopper made available by Goldblatt of Osage, Kans.

The nozzle gun 10 is connected to a suitable source of compressed air (not shown) by conduit 14. As is conventional, communication between the nozzle gun and the source of compressed air is controlled by a trigger mechanism including handle 16. Upon actuation of the trigger handle 16, compressed air will flow through a nozzle 18 which is in at least partial registry with an orifice 20 in an orifice plate 22. In the arrangement illustrated, orifice 20 is only one of several, each orifice being a different size, defined by the orifice plate. These orifices may be selectively indexed over the nozzle 18 by the operator, if desired. Clamping means including a clamping plate 24 held by a mechanical fastener 26 may be utilized to clamp the otherwise rotatable orifice plate 22 in the desired position.

Compressed air delivered to the nozzle gun through conduit 14 and through the nozzle 18 will entrain texturizing material (not shown), such as drywall mud, held within hopper 12 and direct the texturizing material to the desired objective, such as a wall (not shown).

The compressed air exiting the nozzle and the air-entrained texturizing material are sprayed in the form of a diverging stream away from the orifice plate 22. The outer limits of the diverging stream are designated by the lines S in FIG. 2, and it will be seen that the angle of divergence is designated by reference letter A.

As stated above, it is one of the objects of the present invention to redirect the air-entrained texturizing material to form a more concentrated stream and focused spray pattern.

This objective is accomplished by connecting a deflector 30 to the nozzle gun, and more particularly, in the present instance, to the orifice plate thereof. Deflector 30 is in the general shape of a truncated cone and includes a tapered deflector wall 32 which diverges in the direction of the flow path of air exiting from the nozzle 18.

The tapered deflector wall defines an interior passageway, with the wall having an angle of divergence B (see FIG. 2) which is of a lesser magnitude than the angle of divergence A. Therefore, the air-entrained texturizing material will engage the tapered deflector wall 32 and be redirected to form a more concentrated stream and focused spray pattern.

Figure 3:
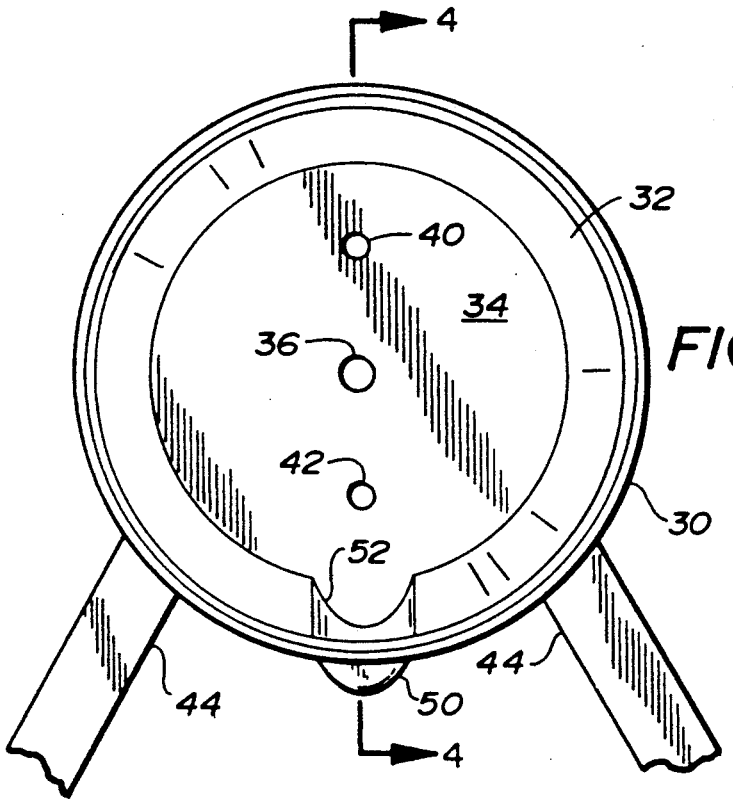
FIG. 3 is an enlarged, front elevational view of the deflector mean of FIG. 1 with a portion thereof broken away.
Figure 4:
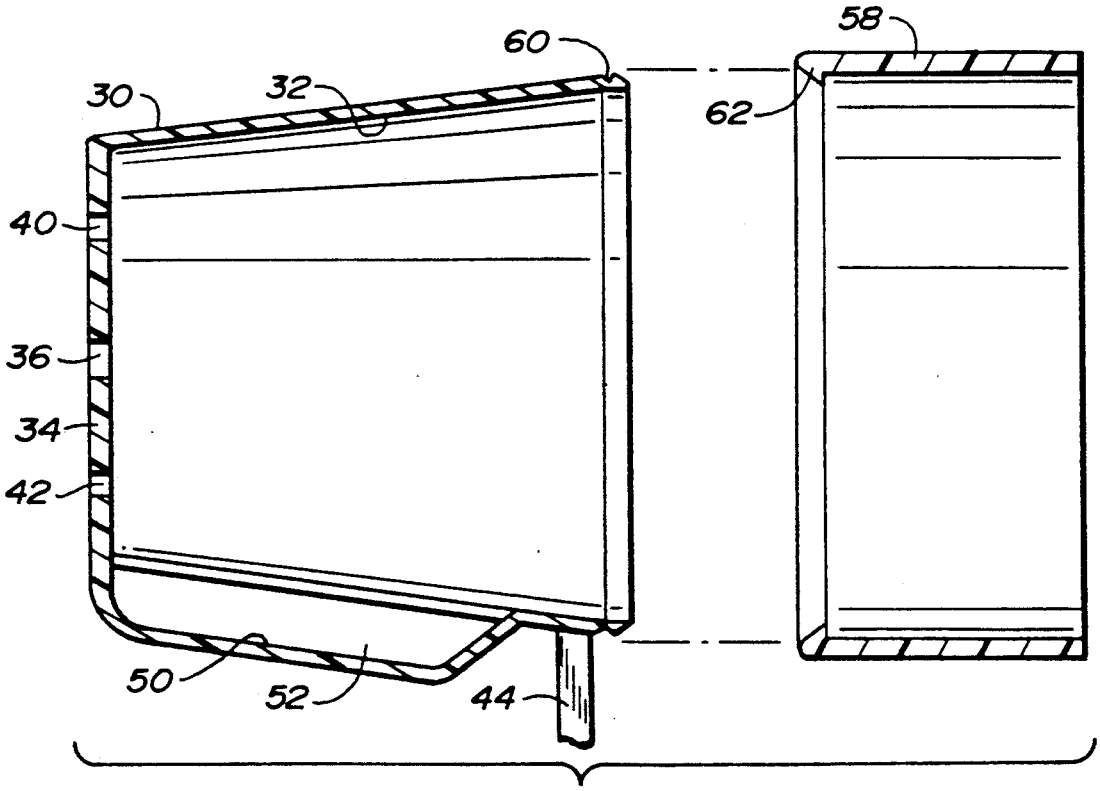
FIG. 4 is a cross-sectional view taken along the line 4—4 of FIG. 3 and illustrating an extension sleeve positioned for application to the deflector means.

The deflector has an inner end comprising a mounting wall 34 (see FIGS. 3 and 4). Mounting wall 34 defines an aperture 36 which is centered with respect to nozzle 18 and orifice 20 when the deflector 30 is connected to the nozzle gun.

Attachment between the deflector 30 and the nozzle gun 20 is accomplished by suitable mechanical connector means. In FIG. 1, for example, a wing-headed bolt 38 may be passed through a hole 40 defined by mounting wall 34 and thence into threaded engagement with the nozzle gun at the center of orifice plate 22. In the embodiment of the invention now under discussion, a second hole, hole 42, is also defined by the mounting plate. Thus, a second threaded fastener may be utilized to secure the deflector in position on the nozzle gun, if desired.

It will be noted that two support legs 44 are affixed to deflector wall 32 and project downwardly therefrom. These two support legs, along with the handle of the nozzle gun 10, cooperate to form a tripod which may be utilized to support the combined texturizer sprayer and deflector on a support surface in a highly stable manner.

It will also be observed that a portion 50 of deflector wall 32 is offset to form a collection chamber 52 for the accumulation of texturizing material which, for some reason, does not exit the collector. This feature contributes to the ability of the present apparatus to assist the operator in maintaining a clean and orderly work environment.

Figure 2:
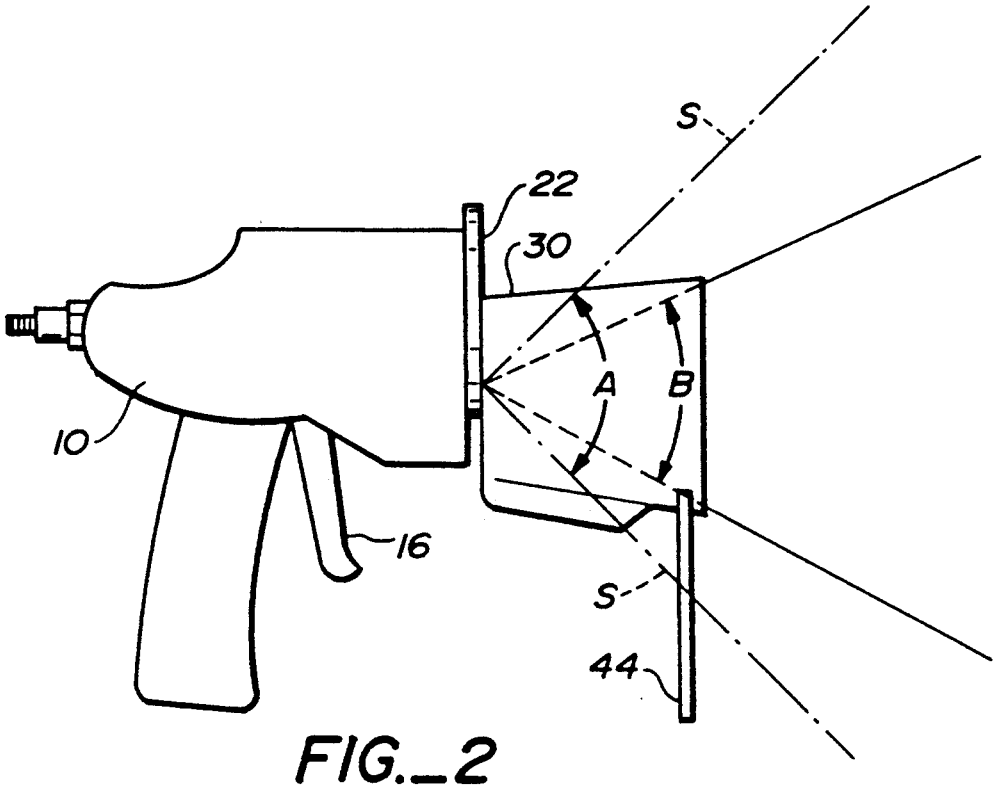
FIG. 2 is a schematic presentation illustrating the operational relationship between the nozzle gun of the texturizer sprayer means of FIG. 1 and the deflector means of FIG. 1.
Figure 2A:
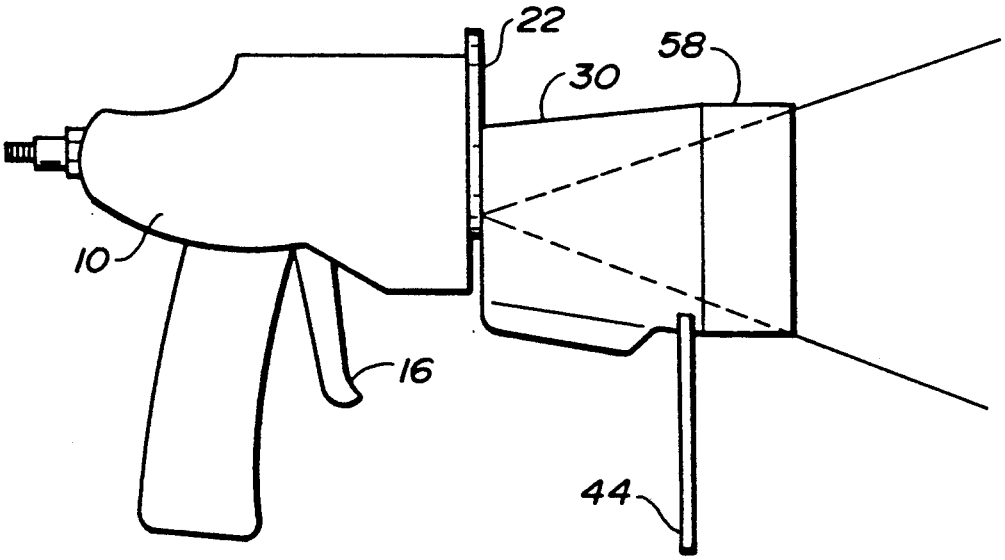
FIG. 2A is a view similar to FIG. 2, but illustrating the deflector means in combination with an extension sleeve.

If desired, an extension sleeve may be employed to extend the length of the deflector and further concentrate the stream of air-entrained texturizing material and further focus the spray pattern. Such a sleeve is shown in FIGS. 2A and 4 and identified by reference numeral 58. In the arrangement illustrated, the outer end of deflector wall 32 has a circumferential notch 60 for receiving a circumferential lip 62 formed on the sleeve. In other words, the deflector and sleeve may be selectively snapped in or out of association. Any suitable material may be utilized to form the deflector and sleeve; however, plastic material is preferred so that the deflector means may be of molded unitary construction.

Figure 5:
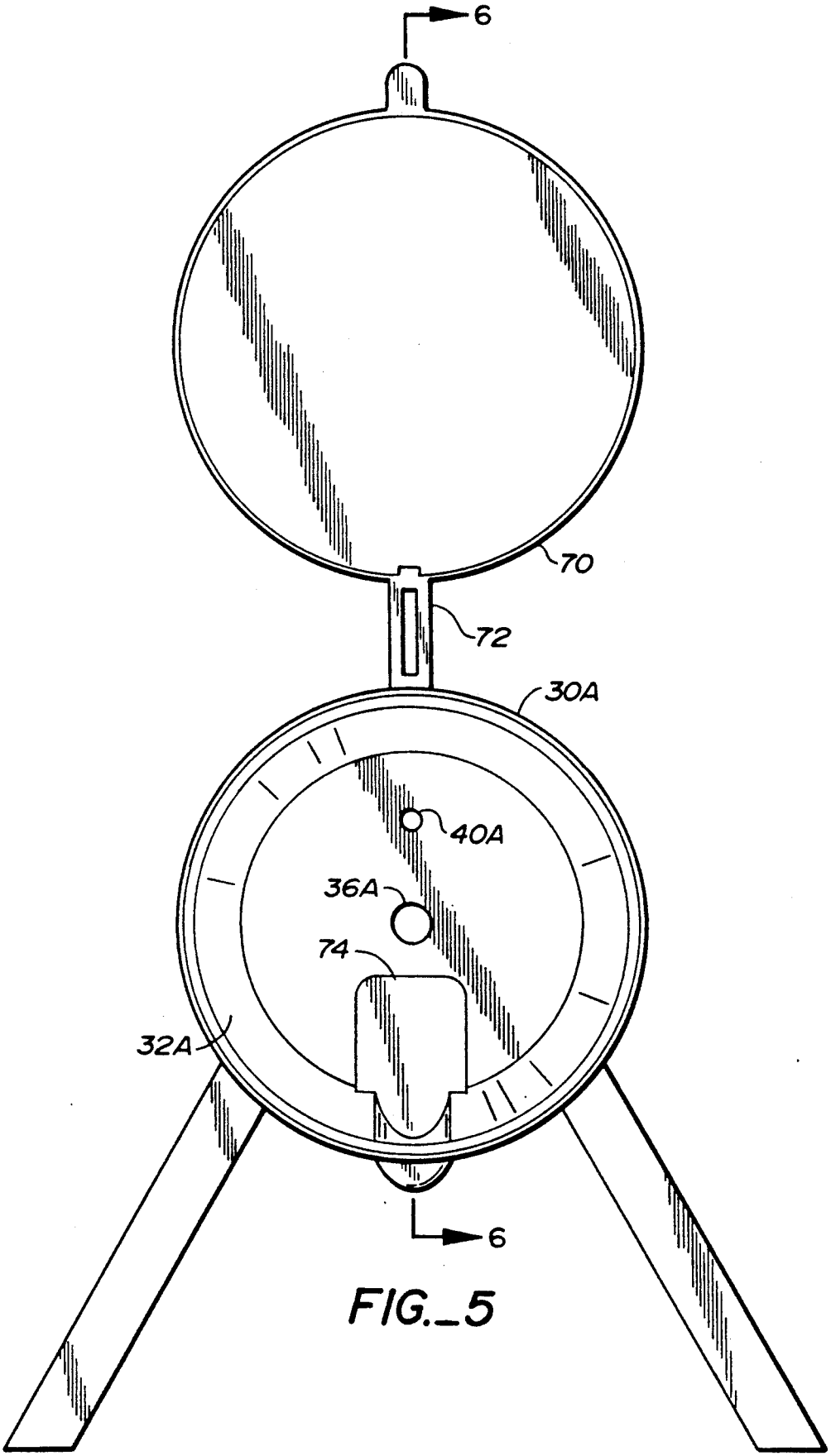
FIG. 5 is an enlarged, front elevational view of an alternative embodiment of the deflector means of the present invention.
Figure 6:
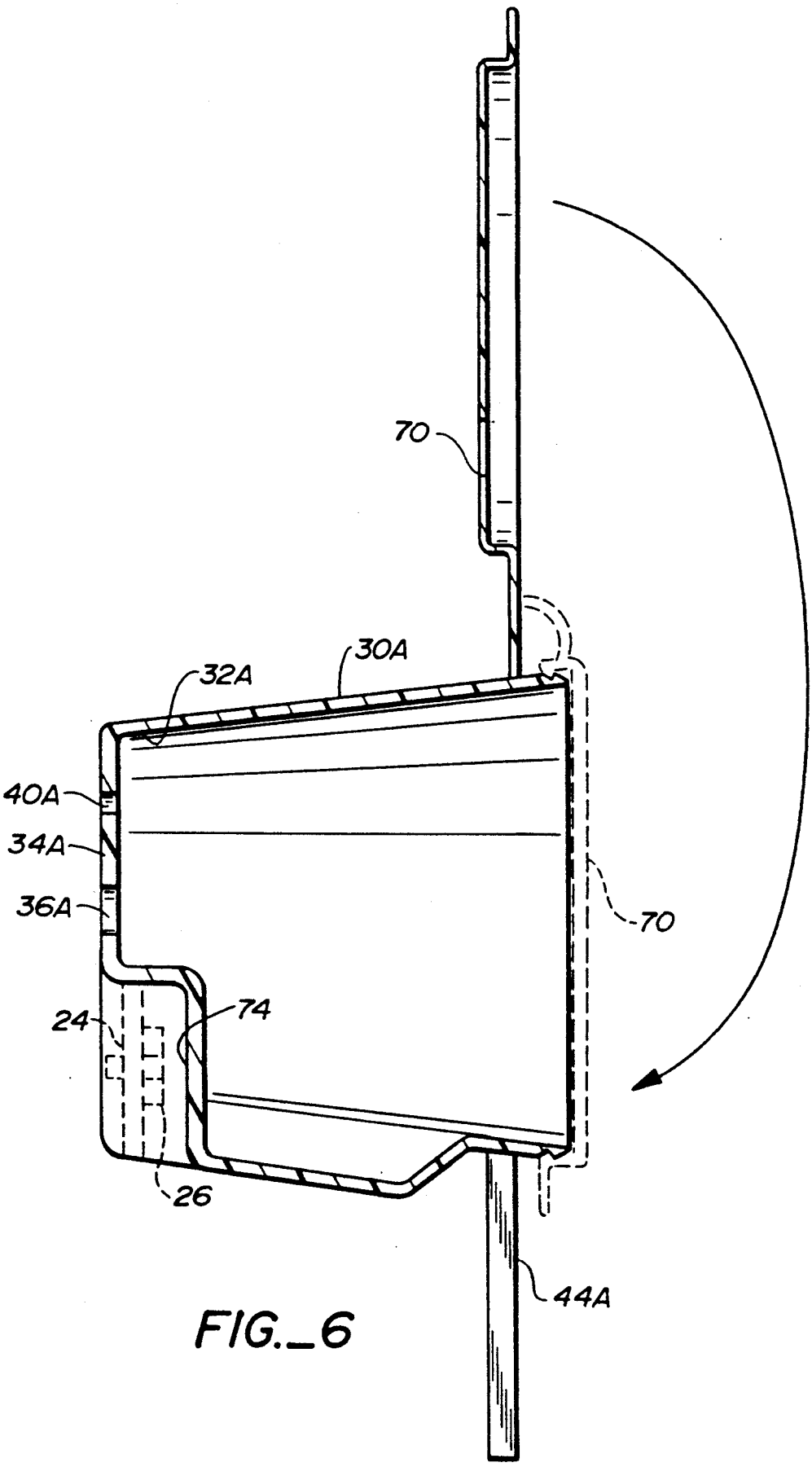
FIG. 6 is a cross-sectional view taken along the line 6—6 of FIG. 5 and illustrating a closure operatively associated with the deflector means in two alternate positions.

FIGS. 5 and 6 illustrate an alternative embodiment of the present invention wherein a closure or cap 70 is integrally attached by means of a strap 72 to tapered deflecting wall 32A of deflector 30A. The closure 70 may moved from the position indicated by solid line in FIG. 6, wherein the outer end of the deflector 30A in completely open, to the position shown by dash lines wherein the open end is closed. This is useful for storage purposes, short term or long term.

Deflector 30A differs from deflector 30 in that the mounting wall 34A is indented to provide a recess 74 for accommodating the clamping plate 24 and fastener 26 when deflector 30A is affixed to the nozzle gun. The aperture 36A will, of course, be centered with respect to the nozzle 18 and orifice 20 of the nozzle gun, as previously described with respect to the first embodiment of the invention. The sole connector means utilized to connect the deflector 30 to the nozzle gun will be a single threaded fastener, such as threaded fastener 38 shown in FIG. 1, inserted through hole 40A. Relative rotation between the deflector 30A and the nozzle gun is prevented by virtue of the fact that the clamping plate 24 will be engaged by the deflector wall 32 where it defines the sides of recess 74.

I claim:

1. Spray control apparatus for use with texturizer sprayer means including a nozzle gun and a hopper connected to said nozzle gun for furnishing texturizing material to said nozzle gun, said nozzle gun having an air nozzle and an orifice plate defining an orifice in communication with said air nozzle, said orifice plate having an outer surface disposed adjacent to said air nozzle and radiating outwardly therefrom in a plane substantially perpendicular to the flow path of air emitted from said air nozzle, said nozzle gun operable to spray a diverging stream of air-entrained texturizing material through said orifice and away from said orifice plate, and said nozzle gun further including a mechanical fastener securing said orifice plate in fixed position relative to said air nozzle, said diverging stream having an angle of divergence of a predetermined magnitude, said spray control apparatus comprising, in combination:

deflector means of unitary construction including a tapered deflector wall defining a passageway and having an inner end and an outer end at opposed ends of said passageway, said deflector means being in the shape of a truncated cone, said inner end comprising a mounting wall defining a centrally located aperture and a mounting hole spaced from said aperture, and said outer end being open over substantially the full extend thereof with said tapered wall being generally uniformly spaced from said centrally located aperture and diverging away from said mounting wall in the direction of said air flow path; and connector means for connecting said deflector means to said nozzle gun, said mounting wall being in engagement with said orifice plate when said deflector means is connected to said nozzle gun with said mounting wall aperture in at least partial registry with said orifice, said connector means including the mechanical fastener projecting through said mounting hole and through said orifice plate and in engagement with said nozzle gun to connect said deflector means to said nozzle gun, and said tapered deflector wall defining a second angle of divergence of a lesser magnitude than the angle of divergence defined by said diverging stream of air-entrained texturizing material whereby said air-entrained texturizing material will engage said tapered deflector wall and be redirected to form a more concentrated stream and focused spray pattern.

2. The combination according to claim 1 wherein said deflector means includes a collection chamber in communication with said passageway for collecting and retaining therein texturizing material failing to exit the open outer end of said deflector means.

3. The combination according to claim 2 wherein said collection chamber is defined by an outwardly offset portion of said deflector wall.

4. The combination according to claim 1 additionally comprising closure means cooperable with said tapered deflector wall for selectively closing said open end whereby said passageway is confined by said closure means and said mounting wall.

5. The combination according to claim 4 wherein said closure means is a cap secured to said deflector wall by a securement strap.

6. The combination according to claim 1 additionally comprising an extension sleeve selectively attachable to said tapered deflector wall at said deflector means outer end to extend the length of said deflector means and further concentrate said stream and focus said spray pattern.

7. The combination according to claim 6 wherein said sleeve is substantially cylindrical.

8. The combination according to claim 1 additionally comprising support means projecting downwardly from said deflector wall to support said texturizer sprayer means and deflector means on a support surface.

9. The combination according to claim 8 wherein said support means comprises a plurality of support legs, said nozzle gun having a handle, and said texturizer sprayer means and connected deflector means being jointly supportable by said support legs and said handle.

10. In combination:

texturizer sprayer means including a nozzle gun and a hopper connected to said nozzle gun for furnishing texturizing material to said nozzle gun, said nozzle gun having at least one air nozzle and an orifice plate defining an orifice in communication with said at least one air nozzle, said orifice plate having an outer surface disposed adjacent to said at least one nozzle and radiating outwardly therefrom in a plane substantially perpendicular to the flow path of air emitted from said at least one air nozzle, said nozzle gun operable to spray a diverging stream of air-entrained texturizing material away from said orifice plate, said diverging stream having an angle of divergence of a predetermined magnitude;

deflector means including a tapered deflector wall defining a passageway and having an inner end and an outer end at opposed ends of said passageway, said inner end comprising a mounting wall defining an aperture and said outer end being open over substantially the full extend thereof; and connector means for connecting said deflector means to said nozzle gun, said mounting wall being in engagement with said orifice plate when said deflector means is connected to said nozzle gun with said mounting wall aperture in at least partial registry with said orifice, and said tapered deflector wall defining a second angle of divergence of a lesser magnitude than the angle of divergence defined by said diverging stream of air-entrained texturizing material whereby said air-entrained texturizing material will engage said tapered deflector wall and be redirected to form a more concentrated stream and focused spray pattern, said nozzle gun including clamp means for clamping said orifice plate, said mounting wall defining a recess for receiving said clamp means, and said clamp means and said mounting wall cooperable to prevent relative rotation between said deflector means and said nozzle gun when said deflector means is connected to said nozzle gun.

* * * * *